US005810536A

United States Patent [19]

McQueeny

[11] Patent Number: 5,810,536

[45] Date of Patent: Sep. 22, 1998

[54] METHOD OF FORMING A PUZZLE BOOK

[75] Inventor: Thomas P. McQueeny, Chicago, Ill.

[73] Assignee: R.R. Donnelley & Sons Company, Chicago, Ill.

[21] Appl. No.: 892,412

[22] Filed: Jul. 14, 1997

Related U.S. Application Data

[62] Division of Ser. No. 627,728, Apr. 2, 1996, Pat. No. 5,683, 112.

[51] Int. Cl.[6] ..... B42C 11/00

[52] U.S. Cl. ..... 412/4; 412/1

[58] Field of Search ..... 412/1, 4; 281/29, 281/15.1, 37, 38, 51; 402/4, 70, 73

[56] References Cited

U.S. PATENT DOCUMENTS

| | | | |
|---|---|---|---|
| 764,441 | 7/1904 | Engel . | |
| 1,189,598 | 7/1916 | McLean . | |
| 1,602,356 | 10/1926 | Franz . | |
| 1,625,053 | 4/1927 | Requa . | |
| 3,078,107 | 2/1963 | Loderhose | 281/29 |
| 3,094,791 | 6/1963 | Thiebes | 35/26 |
| 3,471,962 | 10/1969 | Klein | 46/22 |
| 3,491,196 | 1/1970 | Stein . | |
| 3,815,920 | 6/1974 | Carter et al. | 273/157 R |
| 4,172,332 | 10/1979 | Holes et al. . | |
| 4,176,473 | 12/1979 | Rae | 35/35 E |
| 4,294,469 | 10/1981 | Errichiello . | |
| 4,537,576 | 8/1985 | Thorsheim et al. | 434/404 |
| 4,640,512 | 2/1987 | Burke | 273/157 R |
| 5,149,570 | 9/1992 | Cain | 428/33 |
| 5,165,894 | 11/1992 | Reasoner et al. | 434/345 |
| 5,209,349 | 5/1993 | Porter et al. . | |
| 5,213,507 | 5/1993 | Ozrovitz | 434/178 |
| 5,232,088 | 8/1993 | Leondidis . | |
| 5,362,054 | 11/1994 | Ashemimry | 273/157 R |
| 5,441,262 | 8/1995 | Figone et al. | 273/157 R |
| 5,601,389 | 2/1997 | Minami | 412/4 |
| 5,662,447 | 9/1997 | Tsai | 412/1 |
| 5,683,112 | 11/1997 | McQueeny | 281/29 |
| 5,692,866 | 12/1997 | Hefty | 412/4 |

FOREIGN PATENT DOCUMENTS

| | | | |
|---|---|---|---|
| 261 4840 | 11/1988 | France | 412/4 |
| 4313365 | 10/1994 | Germany . | |
| 342912 | 2/1931 | United Kingdom . | |

*Primary Examiner*—Willmon Fridie, Jr.

*Attorney, Agent, or Firm*—Marshall, O'Toole, Gerstein, Murray & Borun

[57] ABSTRACT

A puzzle book having a front cover, a back cover, a plurality of pages disposed between the front and back covers, and a puzzle disposed on the exterior side of the front cover. The puzzle is composed of a plurality of interlocking puzzle pieces which are disposed in a cavity formed in the exterior side of the front cover. Each of the puzzle pieces has a portion of a printed image formed thereon and a plurality of interlocking portions. The cavity in which the puzzle pieces are disposed may have a shape defined by an internal perimeter of a border area, and the border area may have a plurality of interlocking portions which mate with the interlocking portions of the puzzle pieces to help hold the puzzle pieces within the cavity when the front cover of the puzzle book is opened. The puzzle book may also be provided with a single sheet of transparent material which covers at least a portion of the puzzle and which is removable from the front cover. The transparent material may be a sleeve or band shrink-wrapped around the front cover or a rectangular sheet adhered to the front cover.

6 Claims, 3 Drawing Sheets

METHOD OF FORMING A PUZZLE BOOK

RELATED APPLICATION

This is a divisional of commonly owned, application Ser. No. 08/627,728, filed Apr. 2, 1996, U.S. Pat. No. 5,683,112.

BACKGROUND OF THE INVENTION

The invention is directed to a book which incorporates a puzzle therein.

U.S. Pat. No. 5,213,507 to Ozrovitz discloses a child's story and picture book having a front cover, a back cover, and a plurality of pages pivotally disposed between the front and back covers. At least one of the pages includes text on one or more sides and a puzzle on the other side. The puzzle has a plurality of interlocking puzzle pieces.

The Ozrovitz puzzle pieces may be provided with a transparent material, such as plastic, disposed over and attached to an overlay material. The transparent material on the puzzle pieces allows an erasable material, such as paraffin wax, to be used by a child to color the puzzle pieces. Ozrovitz indicates that the erasable material should preferably cover only the puzzle pieces.

SUMMARY OF THE INVENTION

The invention is directed to a puzzle book having a front cover, a back cover, a plurality of pages disposed between the front and back covers, and a puzzle disposed on the exterior side of the front cover. The puzzle is composed of a plurality of interlocking puzzle pieces which are disposed in a cavity formed in the exterior side of the front cover. Each of the puzzle pieces has a portion of a printed image formed thereon and at least one interlocking portion.

The cavity in which the puzzle pieces are disposed may have a shape defined by an internal perimeter of a border area, and the border area may have a plurality of interlocking portions which mate with the interlocking portions of the puzzle pieces to help hold the puzzle pieces within the cavity when the front cover of the puzzle book is opened.

The front cover, which may have a small semi-circular cavity formed therein to facilitate removal of one of the puzzle pieces, may be composed of a first sheet of substantially rigid material and a second sheet of substantially rigid material fixed to the first sheet. The first sheet may have an image printed thereon which is visible when the puzzle pieces are removed from the puzzle. The puzzle book may also be provided with a single sheet of transparent material which covers at least a portion of the puzzle and at least a portion of the border area and which is removable from the front cover. The transparent material may be a sleeve or band shrink-wrapped around the front cover or a rectangular sheet adhered to the front cover.

The invention is also directed to a method of forming a puzzle book having a front cover, a back cover, a plurality of pages disposed between the front and back covers, and a puzzle associated with an exterior side of the front cover. The method includes steps of printing an image on a first side of a first sheet portion, fixing a second side of the first sheet portion to a first side of a second sheet portion to form the front cover, forming a plurality of cuts in the first sheet portion to form a plurality of interlocking puzzle pieces surrounded by a peripheral cut in the first sheet portion, and binding the pages between the second side of the second sheet portion and the back cover.

These and other features and advantages of the present invention will be apparent to those of ordinary skill in the art in view of the detailed description of the preferred embodiment, which is made with reference to the drawings, a brief description of which is provided below.

DETAILED DESCRIPTION OF A PREFERRED EMBODIMENT

Figure 1:
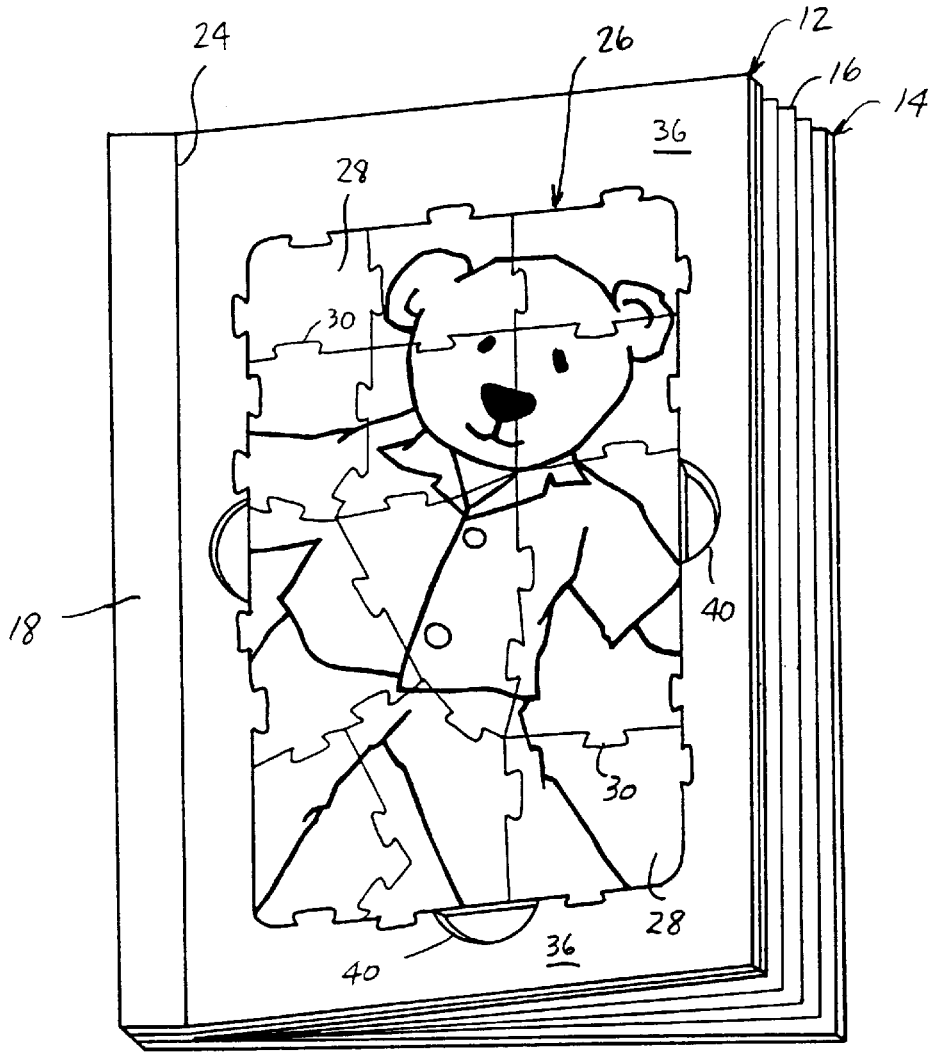
FIG. 1 is a perspective view of a preferred embodiment of a puzzle book in accordance with the invention.
Figure 2:
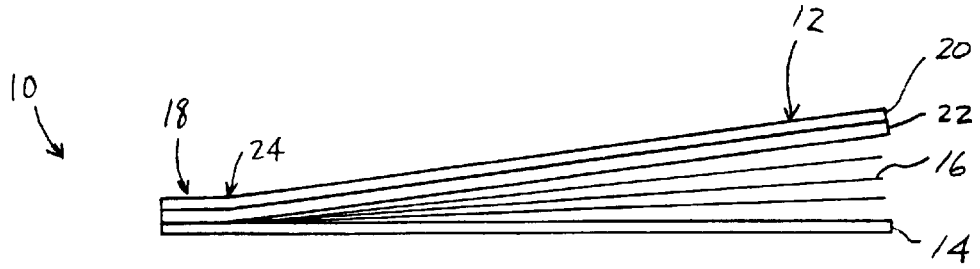
FIG. 2 is a side view of the puzzle book.

FIGS. 1–4 illustrate a preferred embodiment of a puzzle book 10 in accordance with the invention. Referring to FIGS. 1 and 2, the puzzle book 10 has a front cover 12, a back cover 14, and a plurality of pages 16 bound between the front and back covers 12, 14 in a conventional manner at a binding area 18. As shown in FIG. 2, the front cover 12 is composed of an upper sheet 20 of substantially rigid material, such as cardboard, and a lower sheet 22 of substantially rigid material glued or otherwise fixed to the upper sheet 20. A fold or crease 24 is formed in the front cover 12 to facilitate its being opened.

The front cover 12 has a puzzle 26 formed therein. The puzzle 26 is composed of a plurality of puzzle pieces 28 each of which has a portion of an image printed thereon and a plurality of interlocking portions 30. The interlocking portions 30 include a first type, shown as dovetails, and a second type, such as mortises, which are adapted to mate with the first type. Other types of interlocking portions could be used.

Figure 3:
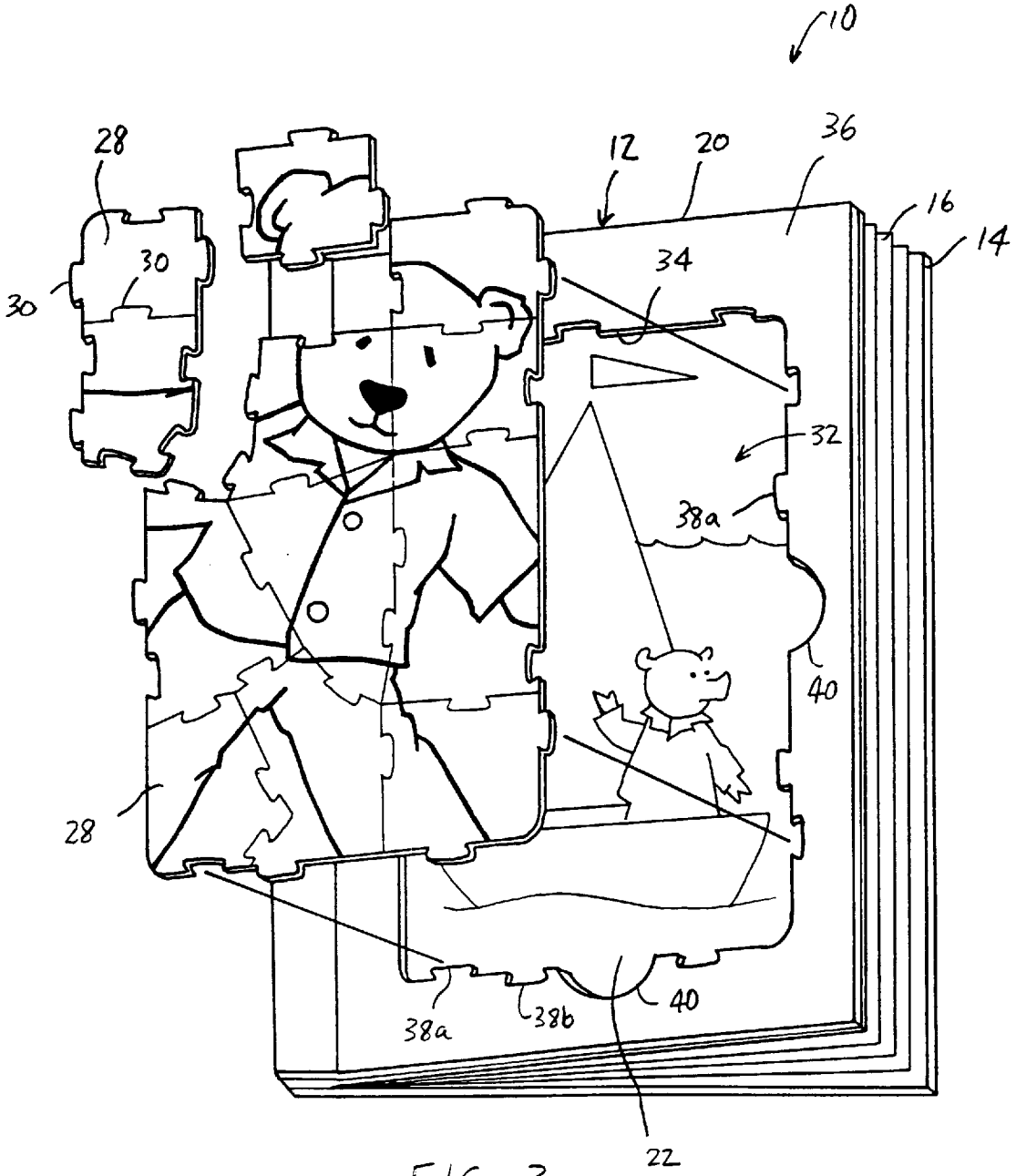
FIG. 3 is an exploded perspective view of the puzzle book.

Referring to FIG. 3, the puzzle pieces 28 are disposed in a cavity 32, formed by a hole or aperture in the upper sheet 20, which has a shape defined by an internal perimeter 34 of a border area 36 of the upper sheet 20. The border area 36 also has a plurality of interlocking portions of two types, including dovetails 38*a* and mortises 38*b*, which are adapted to mate with the interlocking portions 30 of the puzzle pieces 28 to prevent the puzzle pieces 28 from falling out of the cavity 32 when the front cover 12 of the puzzle book 10 is open. The upper side of the lower sheet 22 of the front cover 12 with which the puzzle pieces 28 make contact could optionally be provided with a light-tack adhesive to further help retain the puzzle pieces 28 within the cavity 32.

As shown in FIG. 3, the upper side of the lower sheet 22 of the front cover 12, which is viewable through the cavity 32, has an image printed thereon which is related but different from the image printed on the puzzle pieces 28. Preferably, the image printed on the puzzle pieces 28 does not extend onto the border area 36, and the border area 36 is provided with a color, such as white, that presents a high degree of visual contrast between the puzzle 26 and the border area 36 so that a prospective purchaser immediately recognizes that the book 10 incorporates the puzzle 26 on the front cover 12.

The top or exterior side of the front cover 12 may be provided with one or more semicircular cavities 40 disposed between the border area 36 and one or more of the puzzle pieces 28 to facilitate removal of the puzzle pieces 28 from the puzzle cavity 32.

Figure 4:
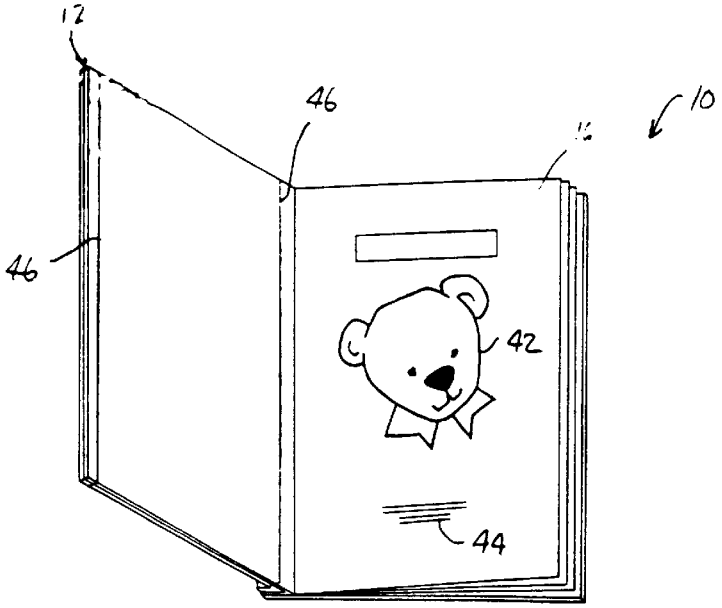
FIG. 4 is a perspective view of the puzzle book with the front cover opened.
Figure 5:
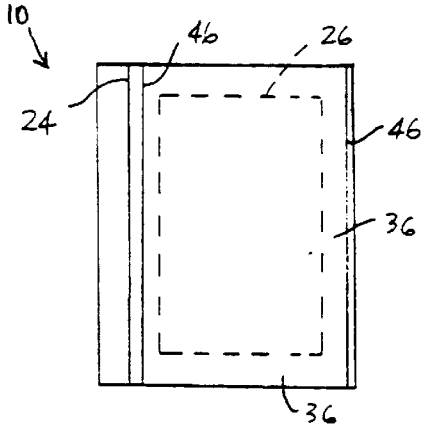
FIG. 5 is a top view of the puzzle book schematically illustrating a shrink-wrapped band which covers a portion of the front cover of the puzzle book.

Referring to FIG. 4, the pages 16 of the puzzle book 10 are printed with pictorial images 42 and text 44 related to the image printed on the puzzle 26. A sheet or band 46 of transparent material may be shrink-wrapped around the exterior and interior sides of the front cover 12 to prevent removal of the puzzle pieces 28 from the puzzle book 10 prior to its being purchased. As shown in FIG. 5, the shrink-wrapped band 46 preferably covers the entire puzzle 26 (shown schematically as a dotted rectangle) and a portion of the border area 36. The shrink-wrapped band 46 is adapted to be removed after purchase of the puzzle book 10.

Figure 6:
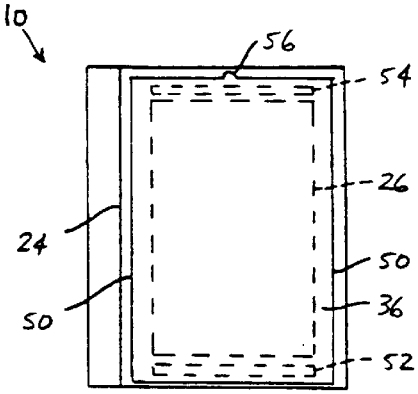
FIG. 6 is a top view of the puzzle book schematically illustrating a sheet of transparent material which covers a portion of the front cover of the puzzle book.

Referring to FIG. 6, as an alternative to, or in addition to, the shrink-wrapped band 46, the exterior side of the front cover 12 may be provided with a rectangular sheet 50 of transparent material which covers the puzzle 26 and a portion of the border area 36. The bottom portion of the transparent sheet 50 may be permanently attached to the cover 12 via an area 52 of permanent adhesive, and the top and/or sides of the sheet 50 may be removably attached to the front cover 12 via one or more areas 54 of touch-sensitive adhesive, so that the transparent sheet 50 may be pulled away from the front face 12 (via a tab 56) to expose to the puzzle 26 and then secured to cover the puzzle 26 by contacting the sheet 50 against the touch-sensitive adhesive areas 54.

Figure 7:
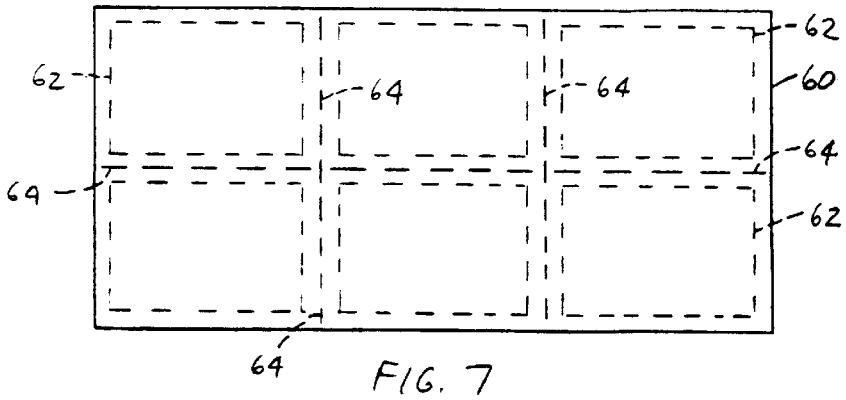
FIG. 7 is a top view of a pair of sheets from which the front cover of the puzzle book may be formed.

The puzzle book 10 may be formed in the following manner. Referring to FIG. 7, the front covers 12 for a plurality, such as six, of the puzzle books 10 may be simultaneously formed from a pair of relatively large sheets 60 of cardboard. Assuming six front covers 12 are to be simultaneously formed, six different areas of one the two sheets 60 are pattern-printed with the puzzle image (i.e. the image on the puzzle pieces 28), and six corresponding areas of the other sheet may be pattern-printed with the image disposed below the puzzle image (i.e. the image in FIG. 3 which appears when the puzzle pieces 28 are removed).

After being printed, one of the sheets 60 is provided with a glue pattern schematically illustrated by the dotted lines which form six rectangular boxes 62 (so that the rectangular border area 36 of each upper sheet 20 of the front cover 12 is fixed to its respective lower sheet 22), and then the two sheets 60 are registered with respect to each other and bonded together.

After being glued together, the sheet 60 having the puzzle image printed thereon is die-cut (simultaneously in six areas) with a pattern of cuts to form, for each of the front covers 12, the interlocking puzzle pieces 28 and a peripheral cut which separates the puzzle pieces 28 from the boundary area 36. The sheets 60 are simultaneously cut along dotted lines 64 to form six separate front covers 12.

After the formation of the front covers 12 as described above, the interior pages 16 of the puzzle book 10 are bound between one of the front covers 12 and a back cover 14 in a conventional manner. After binding, a transparent sheet as described above may be applied to the front cover 12.

It should be understood that the front covers 12 may be separately formed one at a time, instead of being simultaneously formed in multiples as described above.

Modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. A method of forming a puzzle book having a front cover, a back cover, a plurality of pages disposed between the front and back covers, and a puzzle associated with an exterior side of the front cover, said method comprising the steps of:

(a) printing an image on a first side of a first sheet portion;

(b) fixing a second side of said first sheet portion to a first side of a second sheet portion to form said front cover;

(c) forming a plurality of cuts in said first sheet portion to form a plurality of interlocking puzzle pieces surrounded by a peripheral cut in said first sheet portion; and (d) binding said pages between said second side of said second sheet portion and said back cover.

2. A method as defined in claim 1 wherein said step (b) comprises the step of gluing said second side of said first sheet portion to said first side of said second sheet portion.

3. A method as defined in claim 1 additionally comprising the step of (e) affixing a transparent layer of material over at least a portion of said front cover.

4. A method as defined in claim 3 wherein said step (e) comprises the step of shrink-wrapping said transparent layer of material over at least a portion of said front cover.

5. A method as defined in claim 1 additionally comprising the step of printing an image on said first side of said second sheet portion prior to said step (b).

6. A method as defined in claim 1 wherein said step (c) is performed subsequent to said step (b).

* * * * *

UNITED STATES PATENT AND TRADEMARK OFFICE

CERTIFICATE OF CORRECTION

PATENT NO. : 5,810,536
DATED : September 22, 1998
INVENTOR(S) : Thomas P. McQueeny It is certified that error appears in the above-identified patent and that said Letters Patent is hereby corrected as shown below:

Title page,
For the illustrative figure and Drawing Sheet 1, Fig. 1, insert -- 10 --, pointing to the puzzle book. ↘

Drawings,
Sheet 2, Fig. 3, delete "10 ", from the figure.
↘

Column 1,
Line 4, delete "This is a divisional of commonly owned, application Ser. No. 08/627,728, filed April 2, 1996, U.S. Pat. No. 5,683,112" and insert -- This is a divisional of commonly owned, co-pending application Ser. No. 08/627,728, filed April 2, 1996 (Attorney Docket No. 27600/33108). -- therefore.

Column 3
Line 28, delete "to expose to the puzzle" and insert -- to expose the puzzle -- therefore.
Line 37, delete "of one the two" and insert -- of one of the two -- therefore.

Column 4,
Line 17, delete "skilled in the art the best mode" and insert -- skilled in the art of the best mode -- therefore.

Signed and Sealed this

Fifteenth Day of October, 2002

*Attest:*

*Attesting Officer*

JAMES E. ROGAN
*Director of the United States Patent and Trademark Office*